US011344779B2

(12) United States Patent
Williams

(10) Patent No.: US 11,344,779 B2
(45) Date of Patent: May 31, 2022

(54) SPORTS SIGNALING SYSTEM HAVING A SHIELD PROTECTING A PLAYER UNIT

(71) Applicant: Darwin David Williams, New Town, ND (US)

(72) Inventor: Darwin David Williams, New Town, ND (US)

( * ) Notice: Subject to any disclaimer, the term of this patent is extended or adjusted under 35 U.S.C. 154(b) by 0 days.

(21) Appl. No.: 17/356,253

(22) Filed: Jun. 23, 2021

(65) Prior Publication Data

US 2021/0322844 A1 Oct. 21, 2021

Related U.S. Application Data

(63) Continuation-in-part of application No. 16/602,860, filed on Dec. 11, 2019, now Pat. No. 11,071,900.

(60) Provisional application No. 62/779,230, filed on Dec. 13, 2018.

(51) Int. Cl.

| | |
|---|---|
| ***G08B 1/08*** | (2006.01) |
| ***A63B 69/00*** | (2006.01) |
| ***A63B 71/06*** | (2006.01) |
| ***A63B 71/12*** | (2006.01) |
| ***F21V 33/00*** | (2006.01) |
| *F21Y 115/10* | (2016.01) |
| *A63B 102/18* | (2015.01) |

(52) U.S. Cl.

CPC ..... *A63B 69/0002* (2013.01); *A63B 71/0622* (2013.01); *A63B 71/12* (2013.01); *F21V 33/0008* (2013.01); *A63B 2069/0011* (2013.01); *A63B 2071/0655* (2013.01); *A63B 2071/0661* (2013.01); *A63B 2071/0694* (2013.01); *A63B 2071/1208* (2013.01); *A63B 2102/182* (2015.10); *A63B 2225/74* (2020.08); *F21Y 2115/10* (2016.08)

(58) Field of Classification Search

CPC ..... A63B 69/0002; A63B 207/0694; A63B 71/12; A63B 2102/182; A63B 2225/74; A63B 2069/0011; A63B 2071/0655; A63B 2071/0661; F21V 33/0008; F21Y 2115/10

USPC ..... 340/539.11

See application file for complete search history.

(56) References Cited

U.S. PATENT DOCUMENTS

| | | | | |
|---|---|---|---|---|
| 4,525,875 A * | 7/1985 | Tomczak | ..... | A41D 13/0518 2/466 |
| 6,385,781 B1 * | 5/2002 | Rose | ..... | A63B 71/1291 2/468 |
| 6,794,989 B2 * | 9/2004 | Naegely | ..... | G08B 1/08 340/407.1 |
| 8,249,254 B1 * | 8/2012 | Daniel | ..... | A63B 71/06 380/255 |
| 8,696,422 B1 * | 4/2014 | Santiago | ..... | A63B 71/10 273/455 |
| 8,894,514 B2 * | 11/2014 | Jennings | ..... | A63B 71/10 473/468 |

(Continued)

*Primary Examiner* — Zhen Y Wu
(74) *Attorney, Agent, or Firm* — Chen-Chi Lin

(57) ABSTRACT

A sports signaling system comprises a manager unit and a player unit. The manager unit comprises an input device, a wireless transmitter, and a processor. The player unit comprises a wireless receiver, an output device, and a processor. The player unit is embedded in a chest protector worn by a catcher of a baseball game or a softball game. The chest protector comprises a shield protecting the player unit. The shield is made of a polycarbonate material. In one example, an entirety of the player unit is between an inner layer of the chest protector and an outer layer of the chest protector. The player unit does not contact the catcher.

19 Claims, 9 Drawing Sheets

(56) References Cited

U.S. PATENT DOCUMENTS 8,964,980 B2 * 2/2015 Daniel ..... A63B 71/06 380/251
2003/0006903 A1 * 1/2003 Naegely ..... G08B 1/08 340/4.12
2003/0163287 A1 * 8/2003 Vock ..... G01P 3/50 702/187
2005/0170870 A1 * 8/2005 Goldenberg ..... A63B 24/0075 455/575.2
2010/0077536 A1 * 4/2010 Daniel ..... A63B 71/0669 463/31
2010/0080388 A1 * 4/2010 Daniel ..... A63B 71/06 345/55
2010/0138971 A1 * 6/2010 McVeigh ..... A63B 69/0002 2/22
2012/0079647 A1 * 4/2012 Doherty ..... A41D 13/015 2/463
2013/0063268 A1 * 3/2013 Golomb ..... G08B 21/0205 340/573.4
2015/0373450 A1 * 12/2015 Black ..... A41D 27/205 455/11.1
2015/0379351 A1 * 12/2015 Dibenedetto ..... A61B 5/1123 345/633
2017/0065872 A1 * 3/2017 Kelley ..... H04W 4/80
2018/0311555 A1 * 11/2018 Danis ..... A63B 71/0622
2018/0345117 A1 * 12/2018 Andon ..... A63B 71/12
2018/0365939 A1 * 12/2018 Inglot ..... A63B 71/0605
2019/0038932 A1 * 2/2019 Eckblad ..... G06F 9/54
2019/0054347 A1 * 2/2019 Saigh ..... A61B 5/0022
2019/0060736 A1 * 2/2019 Harris ..... H04W 4/80
2019/0091545 A1 * 3/2019 Genova ..... H04W 12/33
2019/0362149 A1 * 11/2019 Mukhopadhyay ... G06K 9/6267
2020/0016474 A1 * 1/2020 Thompson ..... A41D 1/002
2020/0179742 A1 * 6/2020 Kulkarni ..... A63B 21/065
2021/0001225 A1 * 1/2021 Panec ..... A63F 13/65

* cited by examiner

SPORTS SIGNALING SYSTEM HAVING A SHIELD PROTECTING A PLAYER UNIT

CROSS-REFERENCE TO RELATED APPLICATIONS

This patent is a Continuation-in-Part Application of a Non-provisional patent application Ser. No. 16/602,860 filed on Dec. 11, 2019. Non-provisional patent application Ser. No. 16/602,860 claims the benefit of Provisional Patent Application 62/779,230, filed on Dec. 13, 2018. The disclosure made in the Non-Provisional patent application Ser. No. 16/602,860 and the disclosure made in the Provisional Patent Application 62/779,230 are hereby incorporated by reference.

FIELD OF THE INVENTION

This invention relates generally to a sports signaling system. More particularly, the present invention relates to a sports signaling system having a shield protecting a player unit.

BACKGROUND OF THE INVENTION

Baseball and softball coaches often deliver hand signals to defensive players for a variety of situations that may arise during a baseball or softball game. Hand signals may be detected and stolen by the opposing team, leaving the team at a significant disadvantage with their strategy and tactics. Some hand signals may be difficult to discern or see for players in the outfield, such that players in the outfield are unable to effectively communicate with their coach or teammates.

Accordingly, a device that is configured to enable effective and private communication between coaches and players without such communication being compromised or detected by the opposing team is desired.

SUMMARY OF THE INVENTION

A sports signaling system comprises a manager unit and a player unit. The manager unit comprises an input device, a wireless transmitter, and a processor. The player unit comprises a wireless receiver, an output device, and a processor. The player unit is embedded in a chest protector worn by a catcher of a baseball game or a softball game. The chest protector comprises a shield protecting the player unit. The shield is made of a polycarbonate material. In one example, an entirety of the player unit is between an inner layer of the chest protector and an outer layer of the chest protector. The player unit does not contact the catcher.

The manager unit is located at an off-field location (for example, dugout). The player unit is located at an on-field location (for example, embedded in a chest protector worn by a catcher near a home plate).

DETAILED DESCRIPTION OF THE INVENTION

Figure 1:
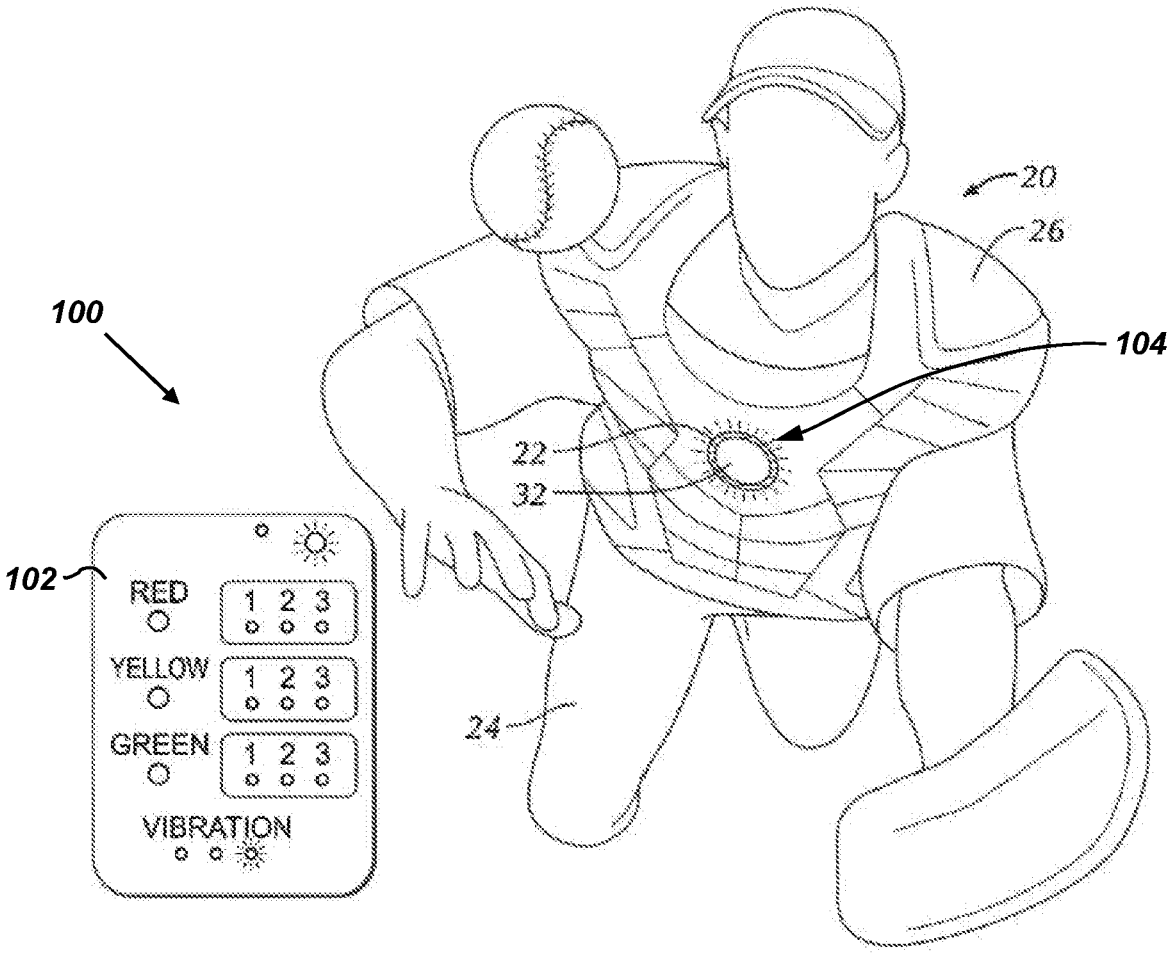
FIG. 1 is a perspective view of a catcher's chest protector with electronic components and a front view of a manager unit in examples of the present disclosure.
Figure 2:
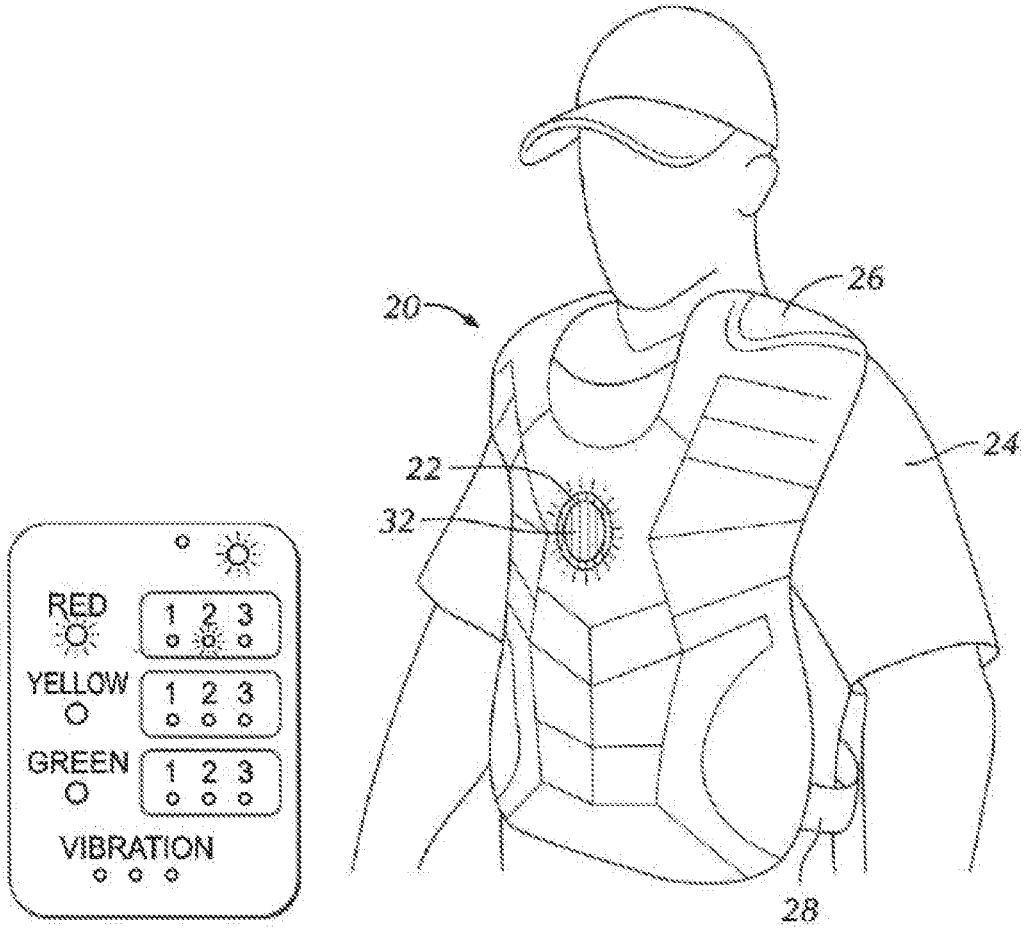
FIG. 2 is another perspective view of the catcher's chest protector and the front view of the manager unit of FIG. 1 in examples of the present disclosure.
Figure 3:
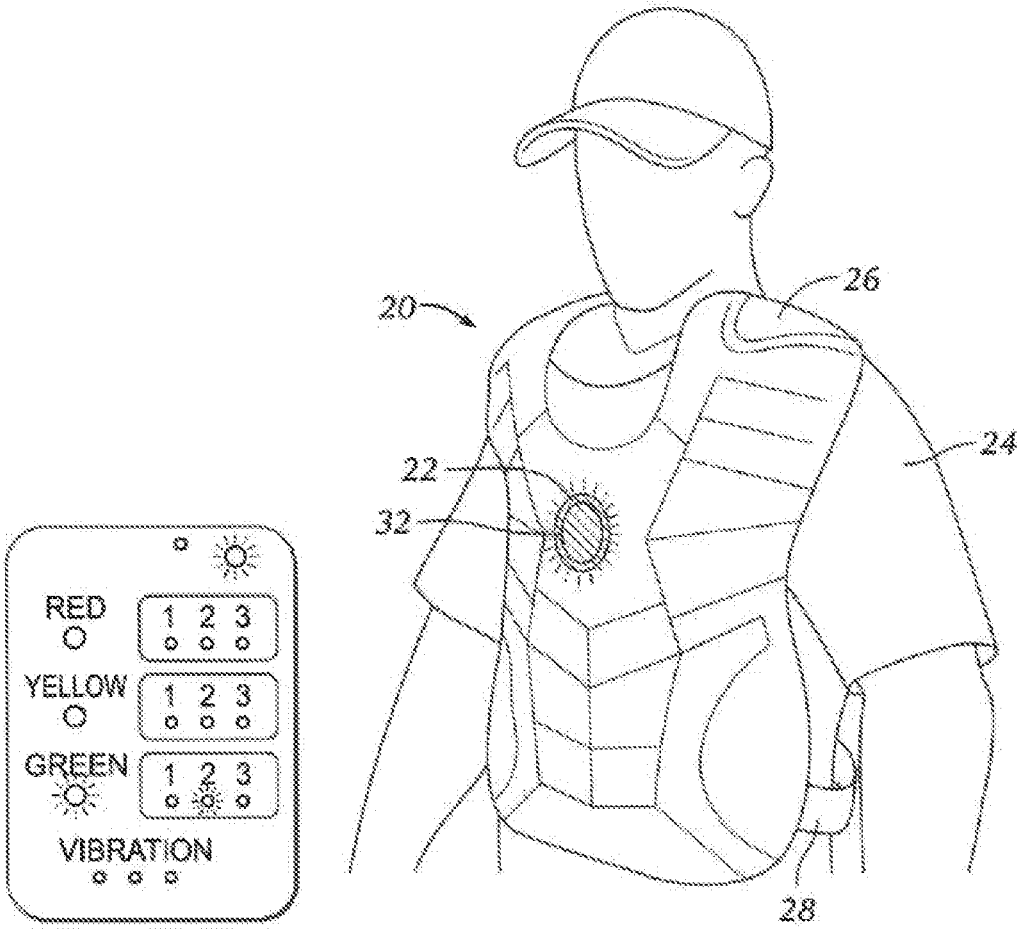
FIG. 3 is another perspective view of the catcher's chest protector and the front view of the manager unit of FIG. 1 in examples of the present disclosure.
Figure 4:
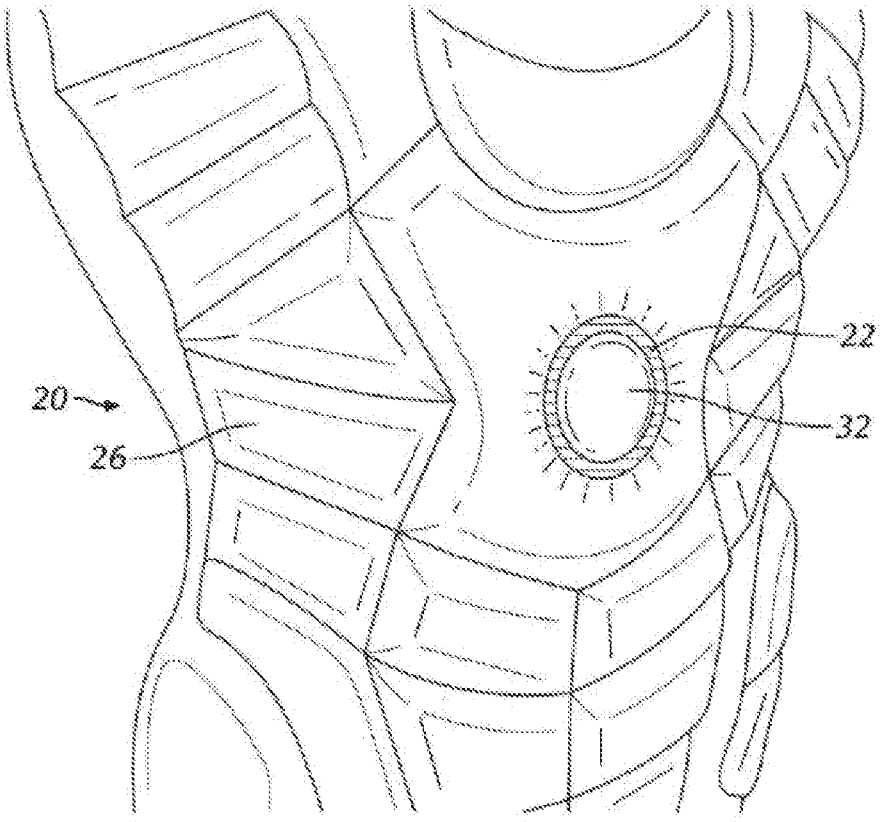
FIG. 4 is a zoomed-in, perspective view of the catcher's chest protector of FIG. 1 in examples of the present disclosure.
Figure 5:
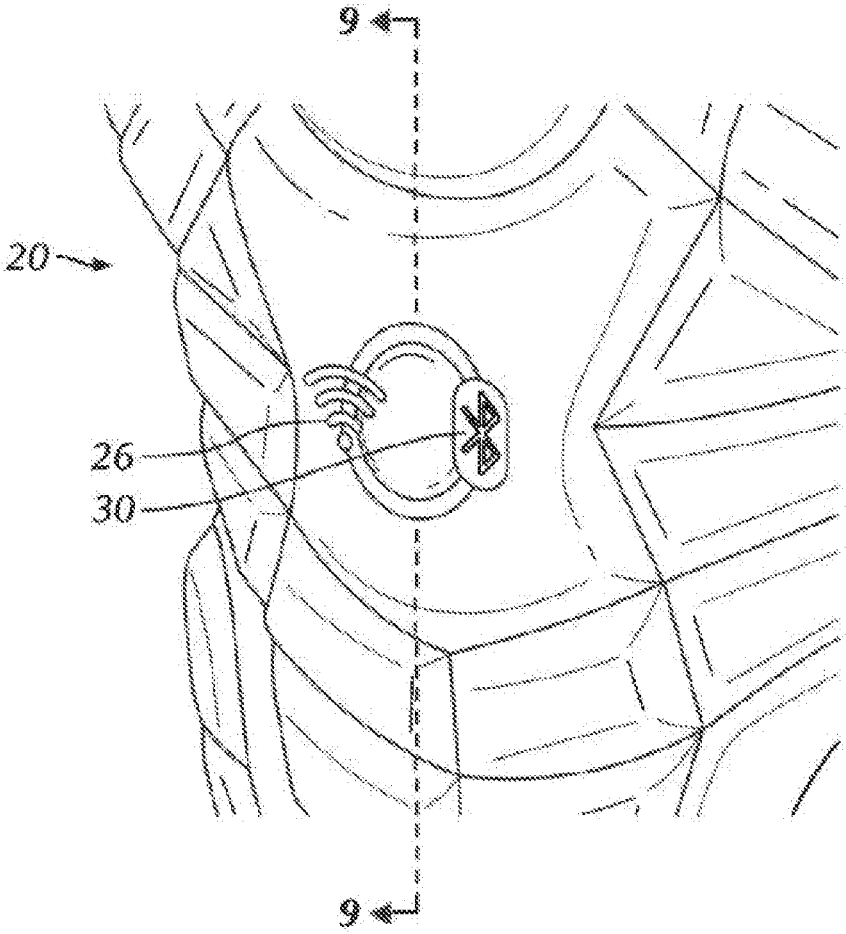
FIG. 5 is another zoomed-in, perspective view of the catcher's chest protector of FIG. 1 in examples of the present disclosure.
Figure 6:
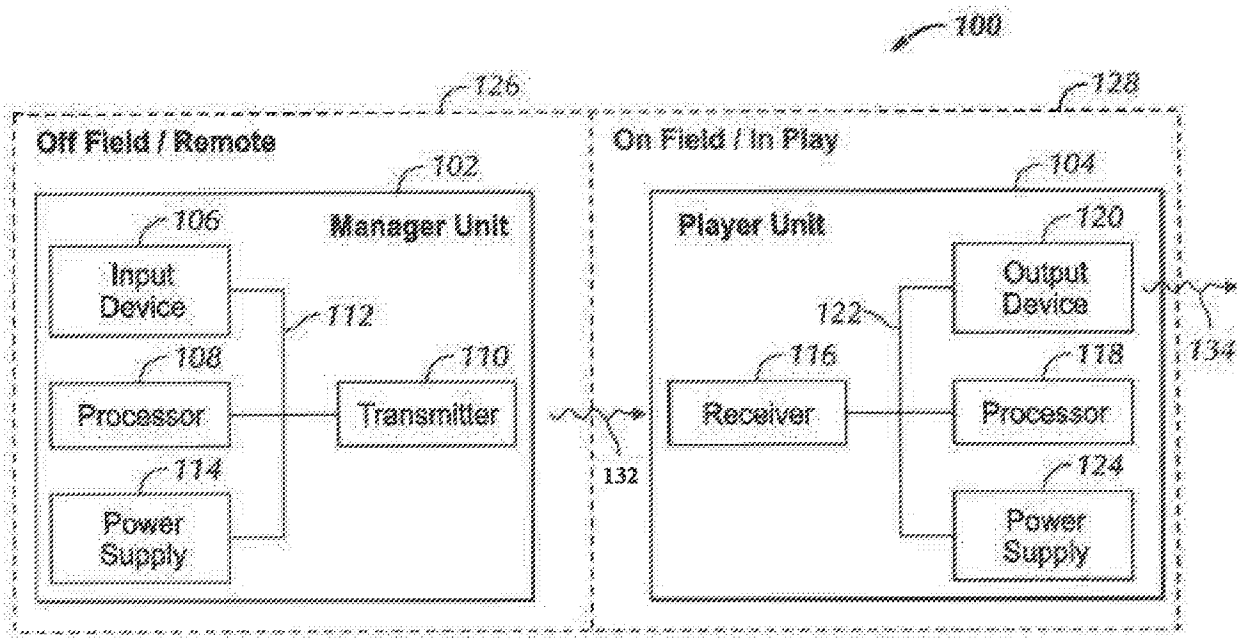
FIG. 6 is a functional block diagram of a sports signaling system including an off-field unit and an on-field unit in examples of the present disclosure.

FIG. 1 is a perspective view of a catcher's chest protector 20 with electronic components 22 and a front view of a manager unit 102 in examples of the present disclosure. FIG. 2 is another perspective view of the catcher's chest protector 20 and the front view of the manager unit of FIG. 1 in examples of the present disclosure. FIG. 3 is another perspective view of the catcher's chest protector 20 and the front view of the manager unit of FIG. 1 in examples of the present disclosure. FIG. 4 is a zoomed-in, perspective view of the catcher's chest protector 20 of FIG. 1 in examples of the present disclosure. FIG. 5 is another zoomed-in, perspective view of the catcher's chest protector 20 of FIG. 1 in examples of the present disclosure. FIG. 6 is a functional block diagram of a sports signaling system 100 comprising an off-field unit (including a manager unit 102) at an off-field location 126 and an on-field unit (including a player unit 104) at an on-field location 128 in examples of the present disclosure.

FIGS. 1-6 show a sports signaling system 100 in examples of the present example. The sports signaling system 100 comprises a manager unit 102 and a player unit 104. The manager unit 102 comprises an input device 106, a wireless transmitter 110, and a processor 108. The input device 106 enables a desired call to be selected from a plurality of possible calls. The wireless transmitter 110 is operatively configured so as to transmit signals from the manager unit 102 to the player unit 104. The processor 108 causes the wireless transmitter 110 to transmit a signal 132 indicative of the desired call. The player unit 104 comprises a wireless receiver 116, an output device 120, and a processor 118. The wireless receiver 116 receives the transmitted signal 132 from the manager unit 102. The output device 120 is operatively configured so as to display or vibrate. The processor 118 causes the output device 120 to output at least one output signal 134 indicative of the desired call. The processor 108 of the manager unit 102 is different from the processor 118 of the player unit 104. The player unit 104 is attached to an equipment (for example, the catcher's chest protector 20 of FIG. 1) configured to be worn by a player (for example, a catcher 24 of FIG. 1).

In one example, the at least one output signal 134 comprises a visual signal indicative of the desired call. In another example, the at least one output signal 134 comprises a vibratory signal indicative of the desired call.

In examples of the present disclosure, the player is a catcher 24 of a baseball game or a softball game. The equipment is a chest protector 20 of the catcher 24. The player unit 104 is embedded in the chest protector (for example, see FIG. 9). The chest protector 140 of FIG. 9 comprises a shield 901 protecting the player unit 104. In one example, the shield 901 is made of a transparent material. In another example, the shield 901 is made of a polycarbonate material.

In examples of the present disclosure, the manager unit 102 further comprises a power supply 114. The power supply 114 supplies electrical power to the manager unit 102. In one example, the power supply 114 comprises a battery. The input device 106, the processor 108, the wireless transmitter 110, and the power supply 114 are connected by wires, cables, or circuitry 112.

In examples of the present disclosure, the player unit 104 further comprises a power supply 124. The power supply 124 supplies electrical power to the player unit 104. In one example, the power supply 124 comprises a battery. The output device 120, the processor 118, the wireless receiver 116, and the power supply 124 are connected by wires, cables, or circuitry 122.

In examples of the present disclosure, the chest protector 20 is a padded chest protector comprising a plurality of paddings 26. The chest protector 20 is of a tapering configuration. The chest protector 20 further comprises an adjustable straps 28, a wireless receiver 30, and an LED display 32. The adjustable straps 28 is for securement of the chest protector 20 to the torso of the catcher 24.

Figure 7:
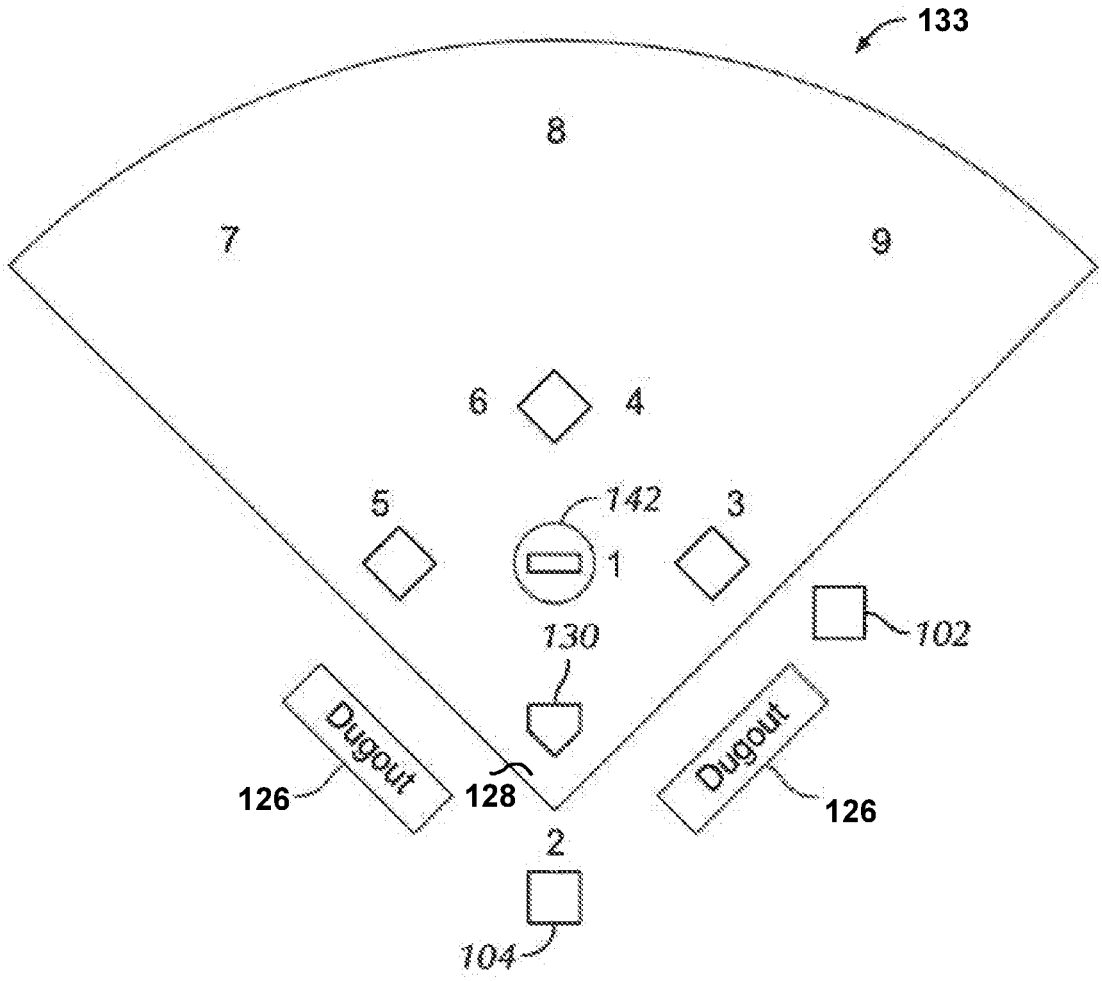
FIG. 7 is a schematic illustration of a baseball or softball field showing the position number of the players in examples of the present disclosure.

FIG. 7 is a schematic illustration of a baseball or softball field 133 showing the position number of the players in examples of the present disclosure. Position 1 is for a pitcher on a pitcher's mound 142. Position 2 is for a catcher. Position 3 is for a first baseman. Position 4 is for a second baseman. Position 5 is for a third baseman. Position 6 is for a shortstop player. Position 7 is for a left outfielder. Position 7 is for a central outfielder. Position 9 is for a right outfielder.

In examples of the present disclosure, the manager unit 102 is located at an off-field location 126 such as at or near a dugout. The player unit 104 is located at an on-field location 128 such as disposed on the catcher (indicated by Player Position 2) at or near the home plate 130 of the field 133.

A method, of using the sports signaling system of FIG. 6, applying to the field 133 of FIG. 7, comprises the steps of: a manager enters a desired call from a plurality of possible calls (e.g., a pitch for a fastball) via the input device 106 of the manager unit 102 from the off-field location 126; the processor 108 then causes the wireless transmitter 110 to transmit a signal 132 indicative of the desired call; the wireless receiver 116 then receives the transmitted signal 132 from the manager unit 102; the processor 118 of the player unit 104, at an on-field location 128, then causes the output device 120 to output a signal 134 indicative of the desired call from the manager.

Figure 8:
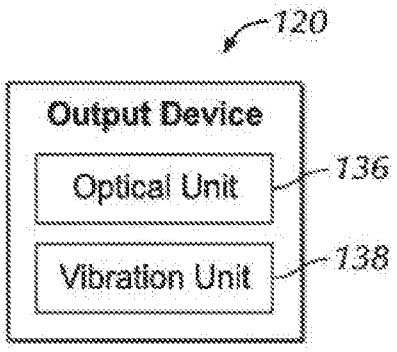
FIG. 8 is a functional block diagram of a manager unit of a player unit in examples of the present disclosure.

FIG. 8 is a functional block diagram of an output device 120 of a player unit 104 in examples of the present disclosure. In one example, the output device 120 comprises an optical unit 136 configured to provide a visual signal indicative of the desired call from the manager. In another example, the output device 120 comprises a vibration unit 138 configured to provide a vibratory signal indicative of the desired call from the manager.

In examples of the present disclosure, the player unit 104 may be disposed on a mask, a shin guard, a helmet, a mitt, or a chest proctor of a catcher.

Figure 9:
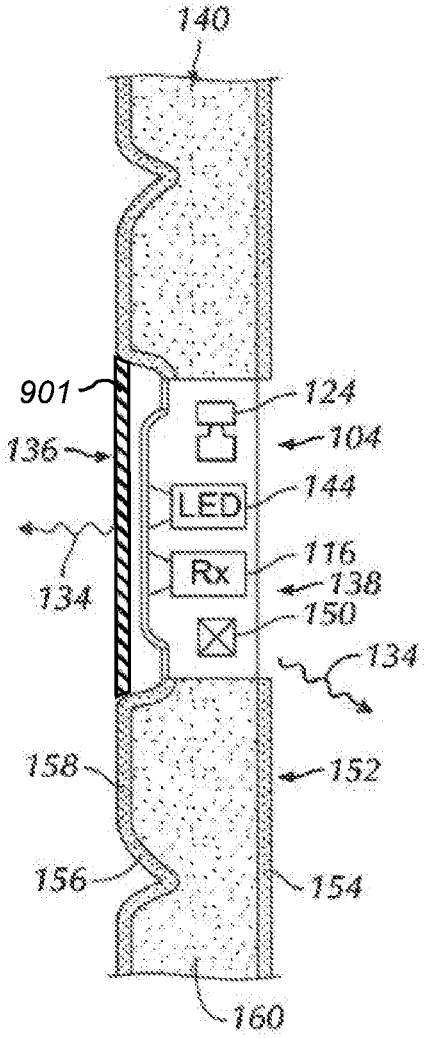
FIG. 9 is a cross-sectional view of the chest protector along line 9-9 of FIG. 5 in examples of the present disclosure.

FIG. 9 is a cross-sectional view of the chest protector 20 along line 9-9 of FIG. 5 in examples of the present disclosure. The player unit 104 is embedded in a chest protector 140 of a catcher. The signal 134 outputted by the output device 120 of FIG. 6 is at least visible to the pitcher (see Position 1 in FIG. 7) located at or near the pitcher's mound 142 of the field 133. The signal 134 may also be visible to other players (indicated by Positions 2, 3, 4, 5, 6, 7, 8, and 9 in FIG. 7) in the field 133.

In examples of the present disclosure, the optical unit 136 illuminates in a plurality of colors. For example, red, green, yellow, and blue. In one example, each color corresponds to one of a plurality of desired calls. In another example, each color is utilized in a particular pattern to represent a desired call. In examples of the present disclosure, the processor 118 of the player unit 104 causes the optical unit 136 to illuminate in a plurality of predefined patterns of colors. Each pattern corresponds to one of a plurality of desired calls. In one example, the optical unit 136 includes a plurality of differently colored LEDs. In another example, the optical unit 136 includes one or more multi-color LEDs. The processor 108 of the manager unit 102 causes the wireless transmitter 110 to transmit a plurality of signals to the player unit 104 indicative of the desired call.

In examples of the present disclosure, the output device 120 of the player unit 104 generates a vibratory signal 134. The vibration unit 138 includes a vibratory device 150 such as a piezoelectric device. The vibration device 150 is disposed on an inner side 152 (near a torso of a catcher) of the chest protector 140 so that the catcher is able to determine the desired call. In examples of the present disclosure, the signal 134 (optical) is transmitted by the optical unit 136. The manager unit 102 includes a plurality of buttons 146 of FIG. 10. When each of the plurality of buttons 146 is activated, the processor 108 of the manager unit causes the wireless transmitter 110 to transmit a respective signal and causes the vibration unit 138 to vibrate.

In examples of the present disclosure, the chest protector 140 includes an inner layer 154 disposed on the inner side 152; an outer layer 156 disposed on an outsider side 158; and a layer of protective padding 160 disposed between the inner layer 154 and the outer layer 156. In one example, the player unit 104 is attached to a surface of the outer side 158 of the outer layer by hook-and-eye fasteners.

In examples of the present disclosure, an entirety of the player unit 104 is between an inner layer 154 of the equipment and an outer layer 156 of the equipment. The player unit 104 does not contact the player wearing the equipment. In one example, the inner layer 154 of the equipment separates the player unit 104 from the player wearing the equipment.

Figure 10:
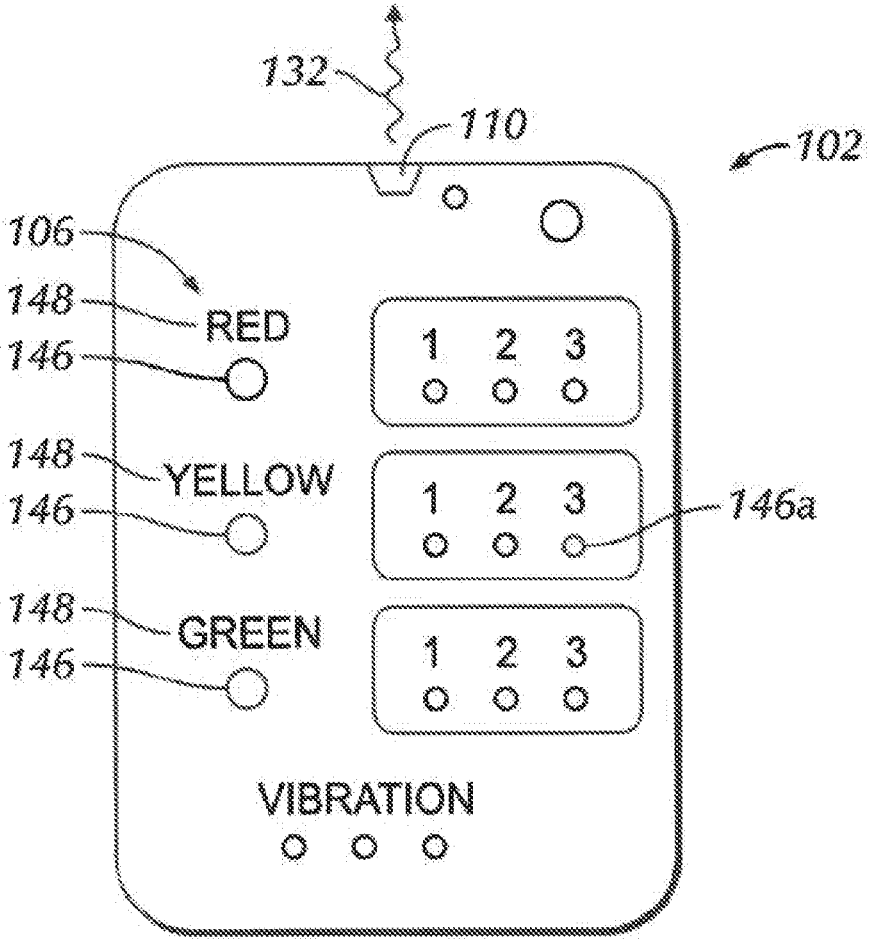
FIG. 10 is a front view of a hand-held manager unit in examples of the present disclosure.

FIG. 10 is a front view of a hand-held manager unit 102 in examples of the present disclosure. The hand-held manager unit 102 may include electro-mechanical input devices or touch-screen input devices. The hand-held manager unit 102 may be an application for a smartphone. The input device 106 of the manager unit 102 may include a plurality of buttons 146. When each of the plurality of buttons 146 is activated, the processor 108 of the manager unit 102 causes the wireless transmitter 110 to transmit a respective signal. The manager unit 102 includes respective indicia 148 corresponds to each of the plurality of buttons 146. For example, RED, YELLOW, GREEN, VIBRATE, 1, 2, and 3. In one example, the manager may actuate the button corresponding to YELLOW 3 (indicated by reference number 146*a*), which would then cause the signal 132 of YELLOW 3 to be transmitted by the wireless transmitter 110. In another example, the manager may actuate two or more of the plurality of buttons 146 to transmit signals corresponding to two or more of desired calls selected from a plurality of desired calls. For example, pitches, locations, and defensive plays. The plurality of buttons 146 may further include buttons corresponding to a plurality of patterns of colors.

Those of ordinary skill in the art may recognize that modifications of the embodiments disclosed herein are possible. For example, a total number of buttons on the manager unit 102 may vary. Other modifications may occur to those of ordinary skill in this art, and all such modifications are deemed to fall within the purview of the present invention, as defined by the claims.

The invention claimed is:

1. A sports signaling system comprising:

a manager unit comprising an input device enabling a desired call to be selected from a plurality of possible calls;

a wireless transmitter operatively configured; and a processor causing the wireless transmitter to transmit a signal indicative of the desired call; and a player unit comprising a wireless receiver receiving the transmitted signal from the manager unit;

an output device operatively configured; and a processor causing the output device to output at least one output signal indicative of the desired call;

wherein the player unit is attached to an equipment configured to be worn by a player;

wherein the player is a catcher of a baseball game or a softball game;

wherein the equipment is a chest protector of the catcher;

wherein the player unit is embedded in the chest protector; and wherein the chest protector comprises a shield protecting the player unit.

2. The sports signaling system of claim 1, wherein the shield is made of a transparent material.

3. The sports signaling system of claim 1, wherein the shield is made of a polycarbonate material.

4. The sports signaling system of claim 1, wherein the at least one output signal comprises a visual signal indicative of the desired call.

5. The sports signaling system of claim 1, wherein the at least one output signal comprises a vibratory signal indicative of the desired call.

6. The sports signaling system of claim 1, wherein the at least one output signal is configured to be visible to at least a pitcher located at a pitcher's mound.

7. The sports signaling system of claim 6, wherein the output device comprises an optical unit configured to display the at least one output signal.

8. The sports signaling system of claim 7, wherein the optical unit illuminates in a plurality of colors; and wherein each color of the plurality of colors corresponds to a respective call of the plurality of possible calls.

9. The sports signaling system of claim 7, wherein the processor of the player unit causes the optical unit to illuminate in a plurality of predefined patterns of colors; and wherein each pattern of the plurality of predefined patterns of colors corresponds to a respective call of the plurality of possible calls.

10. The sports signaling system of claim 9, wherein the optical unit comprises a plurality of differently colored LEDs.

11. The sports signaling system of claim 9, wherein the optical unit comprises a multi-color LED.

12. The sports signaling system of claim 9, wherein the processor of the manager unit causes the wireless transmitter to transmit a plurality of signals to the player unit indicative of the desired call.

13. The sports signaling system of claim 12, wherein the input device comprises a plurality of buttons; and wherein the processor of the manager unit causes the wireless transmitter to transmit a respective signal when each of the button of the plurality of buttons is activated.

14. The sports signaling system of claim 13, wherein a top surface of each of the plurality of buttons comprises a respective color of the plurality of colors.

15. The sports signaling system of claim 7, wherein the output device further comprises a vibration unit configured to vibrate allowing the catcher to determine the desired call.

16. The sports signaling system of claim 7, wherein the input device comprises a plurality of buttons; and wherein the processor of the manager unit causes the wireless transmitter to transmit a respective signal when each of the button of the plurality of buttons is activated.

17. The sports signaling system of claim 1, wherein the chest protector is of a tapering configuration; and wherein the output device comprises a piezoelectric device to vibrate.

18. A method of providing signals in the baseball game or the softball game from an off-field location to the catcher at an on-field location, the method comprising the steps of utilizing the sports signaling system of claim 1, wherein the at least one output signal comprises a visual signal and a vibratory signal; and wherein the manager unit is located at the off-field location and the player unit is disposed on the chest protector worn by the catcher; and a pitcher seeing the visual signal from the output device and the catcher sensing the vibratory signal from the output device.

19. The sports signaling system of claim 1, wherein an entirety of the player unit is between an inner layer of the equipment and an outer layer of the equipment.

* * * * *